US009472131B2

(12) United States Patent
Ghaderi et al.

(10) Patent No.: US 9,472,131 B2
(45) Date of Patent: Oct. 18, 2016

(54) TESTING OF INTEGRATED CIRCUIT TO SUBSTRATE JOINTS

(71) Applicant: Apple Inc., Cupertino, CA (US)

(72) Inventors: Mir B. Ghaderi, Cupertino, CA (US); Shafiq M. Jamal, Pleasanton, CA (US); Sang Y. Youn, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 826 days.

(21) Appl. No.: 13/710,884

(22) Filed: Dec. 11, 2012

(65) Prior Publication Data

US 2014/0125645 A1 May 8, 2014

Related U.S. Application Data

(60) Provisional application No. 61/721,906, filed on Nov. 2, 2012.

(51) Int. Cl.
*G09G 3/00* (2006.01)

(52) U.S. Cl.
CPC ..... *G09G 3/006* (2013.01)

(58) Field of Classification Search
CPC ..... G09G 3/3696; G01R 1/2851
USPC ..... 324/760.01; 345/211, 87
See application file for complete search history.

(56) References Cited

U.S. PATENT DOCUMENTS 5,714,252 A * 2/1998 Hogerton ..... H01L 23/145 174/255
6,218,201 B1 4/2001 Plangger et al.
6,452,502 B1 * 9/2002 Dishongh ..... G01R 31/2856 228/104
6,535,005 B1 * 3/2003 Field ..... G01R 31/281 324/763.01
6,940,301 B2 * 9/2005 Chen ..... G01R 27/205 324/760.01
2002/0053735 A1 * 5/2002 Neuhaus ..... H05K 3/325 257/728
2008/0218495 A1 * 9/2008 Lin ..... G09G 3/006 345/204
2010/0295567 A1 * 11/2010 Chang ..... G01R 31/046 324/719
2012/0161660 A1 * 6/2012 Joo ..... G09G 3/20 315/240
2012/0262886 A1 * 10/2012 Yamagishi ..... G02F 1/13452 361/749

(Continued)

OTHER PUBLICATIONS

Beckers, Leo, et al., "Contact Resistance Measurement for Au Bumped IC to ITO on Glass for LCD's", Polytronic 2005—5th International Conference on Polymers and Adhesives in Microelectronics and Photonics (Oct. 23-26, 2005), (pp. 155-159).

(Continued)

*Primary Examiner* — Patrick Assouad
*Assistant Examiner* — Khristopher Yodichkas
(74) *Attorney, Agent, or Firm* — Blakely, Sokoloff, Taylor & Zafman LLP

(57) ABSTRACT

A method for testing integrated circuit-to-substrate joints that electrically connect an IC to a substrate. An ammeter is coupled to a test node of the driver IC, while the test node is coupled to a current source, and a measured current output of the ammeter is recorded. A voltmeter is coupled to the test node while the test node is coupled to an end node of a group of dummy IC-to-substrate joints that are daisy chained; a first measured voltage output of the voltmeter is then recorded. The IC then couples the test node to another end node of the daisy chained dummy joints, and a second measured voltage output is recorded. A resistance or admittance value for the electrical connection of the IC to the substrate is then computed, using the first and second measured voltage outputs and the measured current output. Other embodiments are also described and claimed.

16 Claims, 6 Drawing Sheets

(56) References Cited

U.S. PATENT DOCUMENTS

2012/0268147 A1* 10/2012 Chen ..... G01R 31/048 324/713
2014/0062845 A1* 3/2014 Brahma ..... G09G 3/006 345/92

OTHER PUBLICATIONS

Uddin, M. A., et al., "Contact Resistance of Anisotropic Conductive Adhesive Film Based Flip-Chip on Glass Packages", Rev. Adv. Mater, Sci. 27 (2011), (pp. 151-157).

* cited by examiner

TESTING OF INTEGRATED CIRCUIT TO SUBSTRATE JOINTS

RELATED MATTERS

This application claims the benefit of the earlier filing date of provisional application No. 61/721,906, filed Nov. 2, 2012, entitled "Testing of Integrated Circuit to Substrate Joints".

An embodiment of the invention relates to the testing of electrical contacts or joints that are made between the pads of a display driver integrated circuit die and counterpart conductive pads formed on a substrate such as a glass or plastic panel, which may be part of a electronic display system such as a liquid crystal display (LCD) panel. Other embodiments are also described.

BACKGROUND

Flat panel displays such as liquid crystal display (LCD) and plasma types are typically used in consumer electronics devices such as desktop computers, television sets, and portable devices such as smart phones, tablet computers, and notebook computers. Such a flat panel display contains an array of display elements or pixels that are formed on a display panel substrate that is made of substantially transparent materials including one or more glass panels. The array of display elements may be overlaid with a grid of data and control conductors, referred to as data lines and gate lines that are also formed on the display panel. In a high-resolution panel, there may be tens of thousands of pixels where each is to receive a signal that represents a digital picture element to be displayed at that location. The picture element signals together with control signals are applied to the conductive grid of gate lines and data lines by a display driver integrated circuitry (some times referred to as a display driver or source driver integrated circuit, IC, or simply a driver IC). The driver IC may be a microelectronic semiconductor die that contains the needed circuitry to translate incoming video and touch transducer signals for example from an external video/graphics/touch controller, into the data and control signals for driving the pixel array. The driver IC may also receive other control signals as well as power, from an external power supply circuit, for example as part of a power management unit integrated circuit.

The external circuitry is electrically connected to the driver IC via conductive traces that may also be formed in the display panel substrate, while some of the external circuitry may be off-the-panel and accessible via for example a flexible carrier circuit. As a result, to transfer the electrical signals and power between the driver IC and external circuitry, there is a need for a reliable and low impedance electrical interconnect between the driver IC and the conductive traces that are formed in the display panel substrate. For example, a chip-to-substrate (CoG) joint is typically made between a pad of the driver IC and a counterpart pad or trace formed in the display panel substrate. Sometimes, flip chip interconnect technologies are also used to achieve hundreds of such CoG joints. Low cost techniques used to form such joints include conductive adhesive film, which do not always provide for a well-controlled or narrow range of low resistance, across a large number of such joints. As a result, there is a need to measure the electrical resistance of such joints particularly during manufacturing testing, so as to be able to screen out those parts that are outside a specified resistance range. That is, a display system that has a large number non-conforming CoG joints (greater than a specified resistance) may result in greater power consumption and/or slower signal transitions, thereby potentially causing functional failures in the display system.

SUMMARY

An embodiment of the invention is an integrated circuit (IC) whose IC-to-substrate electrical joints may be tested with improved accuracy. The testing technique may be described as a "direct" resistance measurement technique, where a well-controlled dc current, i.e. substantially independent of the "load" voltage, is forced through a number of daisy chained dummy joints. Each dummy joint may be deemed a replicate of an "actual" joint used to transfer a data signal, a control signal, or power, for use by the IC. The current may be provided by an accurate current source, such as a cascode-type that may ensure higher impedance and hence less sensitivity of the current to the "load". The current may be measured using an ammeter circuit. A voltage divider network is created using the daisy chained dummy joints, which may be in series with a resistor. Two voltages are measured from the daisy chained dummy joints (using a voltmeter circuit), while the current is being passed through the joints. A resistance (or admittance) value is then computed using a difference between the measured voltages and the measured current. This resistance value may be deemed a good estimate of the resistance of a group of actual joints (of the same number as the dummy joints), especially when the routing that is added to form the daisy chaining is designed for relatively negligible resistance (relative to the resistance of a joint). The technique may be implemented with the help of automatic test equipment, for high volume manufacturing of display systems.

Primary sources of error in the technique are likely to be the ammeter, the voltmeter, and the current source. In one case, the current source may be implemented within the IC, such as a display driver IC, and may exhibit a difference of, for example, up to 10% in its output current between driving a) the ammeter circuit and b) the daisy chained dummy joints and the series resistor. However, the voltmeter and ammeter may be external, instrument-grade devices (e.g., part of dedicated microelectronic test equipment) and as a result could have for example at most a 1% error in their readings. This enables the total error for the computed resistance estimate to be on the order of no more than 10% in some cases, which is welcome accuracy for certain measurement tasks, particularly the measurement of CoG and FoG resistance in glass panel display systems. A particularly efficient circuit for integrating such capability into a display driver IC is also described.

In one embodiment, an integrated circuit (IC) has a number of pads to transfer signals between the IC and external circuitry, wherein the pads are to form a IC-to-substrate joints on a substrate. In addition, there are further pads that are to form dummy IC-to-substrate joints on the substrate. These are to be daisy chained using routing on the substrate and routing in the IC. A switch network selectively routes current produced by a current source through a) a test node of the IC, b) the daisy chained dummy joints while connecting an end node of the daisy chained dummy joints to the test node, and c) the daisy chained dummy joints while connecting another end node of the daisy chained dummy joints to the test node.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
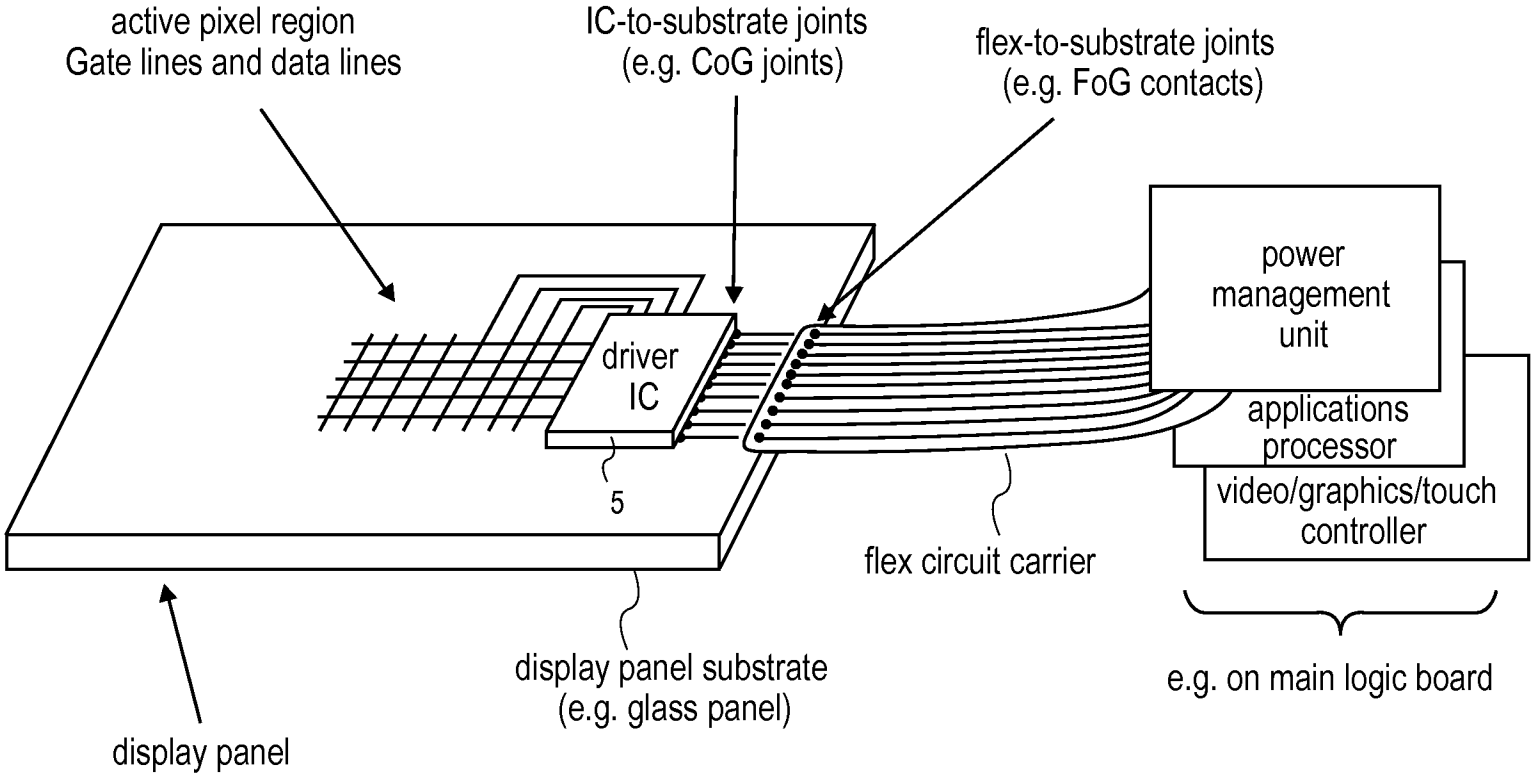
FIG. 1 depicts part of a display system in which an embodiment of the invention can be implemented.

FIG. 1 depicts part of a display system in which an embodiment of the invention can be implemented. The display system may be embedded into a consumer electronics product, such as for example a tablet computer, a smartphone, and a notebook computer. The display panel is composed of a display panel substrate (e.g., a multilayer glass panel, a ceramic panel, a polycarbonate panel, or other suitable light transmitting panel materials) on which an active pixel region overlaid with a grid of gate lines and data lines are formed. An example of such a display panel is an LCD active matrix panel. Driving the data lines of the active pixel region is a driver IC 5, which may be a conventional source driver circuit that drives the data lines with pixel values that it translates from incoming digital video signals. The latter may be received from an off-panel video/graphics/touch controller, or from an applications processor. The driver IC 5 also receives control signals and power from an external power management unit, which may include power supply circuits used to power and enable the display driver IC 5 to drive the active pixel region. Although not shown in FIG. 1, there may also be other external circuitry, i.e. external to the driver IC 5, installed on the panel substrate and that may need an electrical interface with the driver IC 5 (through conductive traces formed in the panel substrate).

Signals and power may be transferred between the driver IC 5 and external circuitry through hundreds of IC-to-substrate joints (only a few of which are shown for convenience). These may be chip-on-glass (CoG) joints or contacts formed for example using conductive adhesive flip chip bonding techniques, which is a chip integrated circuit die interconnect technique where the driver IC 5 is a semiconductor IC die having bond pads formed on its top surface that is then flipped over, and then each bond pad may form a CoG joint with a counterpart region of an adhesive film on the top surface of the display panel. As an alternative, the driver IC 5 may be a packaged IC die or a multi-chip module whose IC-to-substrate joints may be formed using different techniques. The joints may serve to conduct or transfer signals and power between the driver IC 5 and external circuitry.

FIG. 1 shows the case where signals and power are routed via conductive traces formed in the display panel substrate, between the IC-to-substrate joints and a number of flex-to-substrate joints, e.g. flex-on-glass or FoG. The latter may also be formed by applying an adhesive conductive film to the top surface of the display panel where the conductive traces are formed, and then enabling the pads that are on a back face of the flex circuit to bond to the touching portions of the adhesive film (through heating for instance). The flex-to-substrate joints then serve to route the signals and power between the display panel and off-panel circuitry, by connecting to a flexible printed circuit carrier. The off-panel circuitry may include any one or more of a power management unit, an applications processor and a v/g/t controller (some or all of which may be on a main logic board of the product). The resistance measurement techniques described below may also be applied to measure the resistance of a group of CoG-FoG joint pairs.

Figure 2:
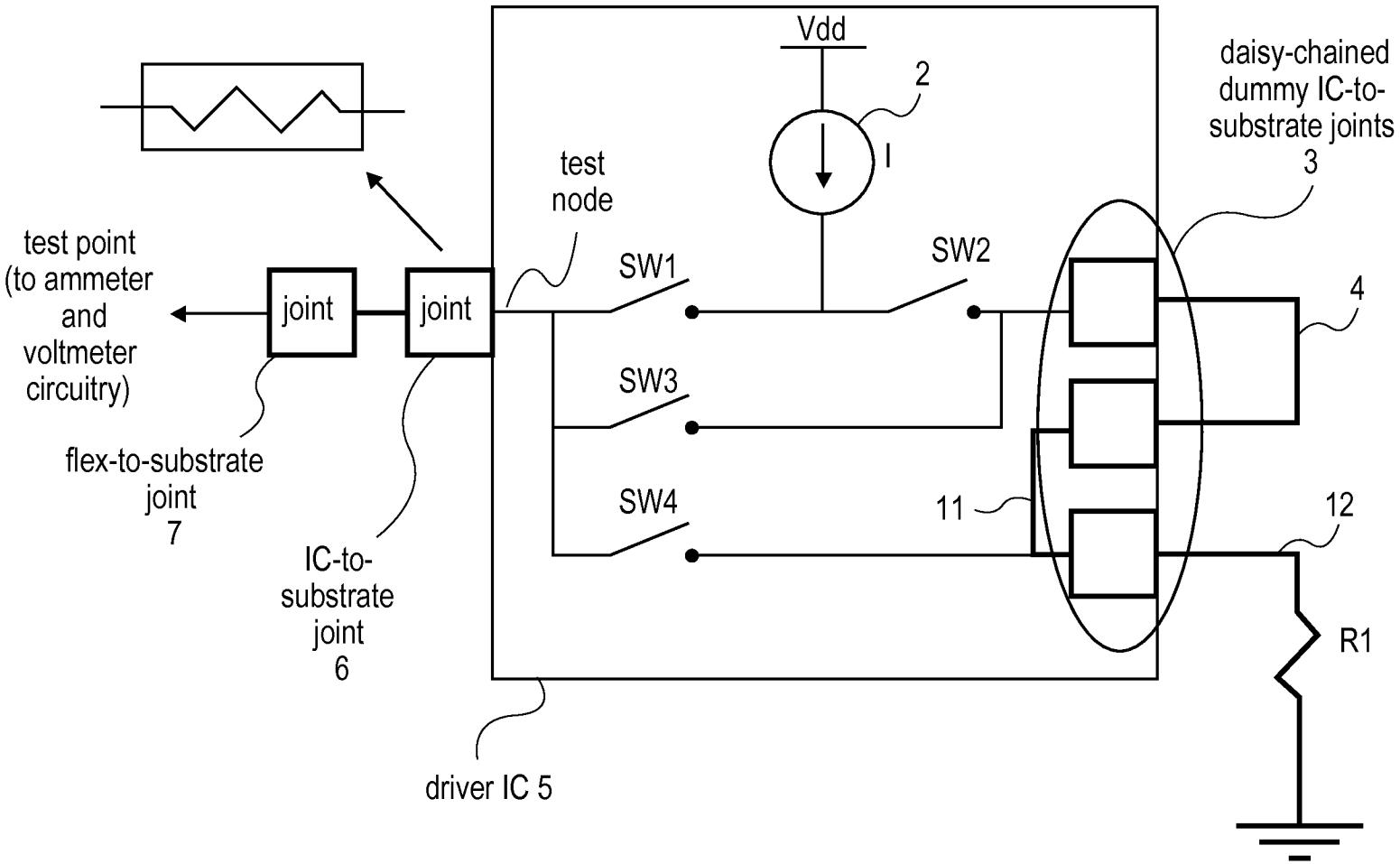
FIG. 2 is a circuit schematic of IC-to-substrate joint testing circuitry, that may be implemented within a display driver IC as it is installed on a display panel substrate.

FIG. 2 is a schematic of a circuit for testing IC-to-substrate joints. The circuit may in part be implemented within the IC itself whose joints are to be tested, e.g. the display driver IC 5 as installed on a display panel substrate as shown in FIG. 1. In addition to tens or hundreds of actual electrical connection pads (which are not shown in this figure), the driver IC 5 has a group of dummy pads that are formed into dummy IC-to-substrate joints 3 (e.g., dummy CoG joints). Each dummy joint may be deemed a replicate of an "actual" joint used to transfer a data signal, a control signal, or power, as part of the normal electrical interconnect used by the IC. The dummy joints 3 are daisy chained as shown, using traces or nodes formed on the substrate and on the IC. In this example, the group has three adjacent pads where the first one (from the top) is directly connected to the second one via an on-substrate conductive route or trace 4. Furthermore, the second one is directly connected to the third one via a conductive route or trace 11 that is within the IC (e.g., within the driver IC die). This forms a daisy chain. Of course, the actual number of pads/joints that are daisy changed may vary as described below, but in general it is expected to be at least two. The last (here, third) joint is directly connected, via a further conductive route or trace 12, to a power supply or power return node, here ground.

In one embodiment, a resistor R1 is coupled in series with the dummy joints 3, here between the third joint and ground. The resistor R1 may be a passive resistor element that may be installed on the display panel substrate or on a connected flexible printed circuit carrier (e.g., as connected through a FoG joint—see FIG. 1 for example). As another alternative, the resistor R1 may be placed in the driver IC die 5. The measurement techniques described here are not sensitive to the value of this resistor; in fact, in one embodiment, the resistor R1 may be essentially omitted, i.e. in favor of a short circuit path through the trace 12 to ground (for the example of FIG. 2). The arrangement of the daisy chained joints 3 and the optional resistor R1 as shown in FIG. 2 form a voltage divider network whose voltages of interest, as explained below, are at opposite end nodes of the daisy chain 3.

A current source 2 provides a current I. The current source 2 should be sufficiently accurate, as it will be a primary source of error in the computed resistance estimate. In other words, the current I should be a fixed, dc current that varies as little as practically possible, despite changes in its voltage. A cascode-type current source is expected to work well here, as it is able to provide a sufficiently high impedance (Thevenin equivalent), for the expected change in "load" that is seen by the current source during the testing. The term current "source" is used here generically to also encompass a current sink.

Figure 3A:
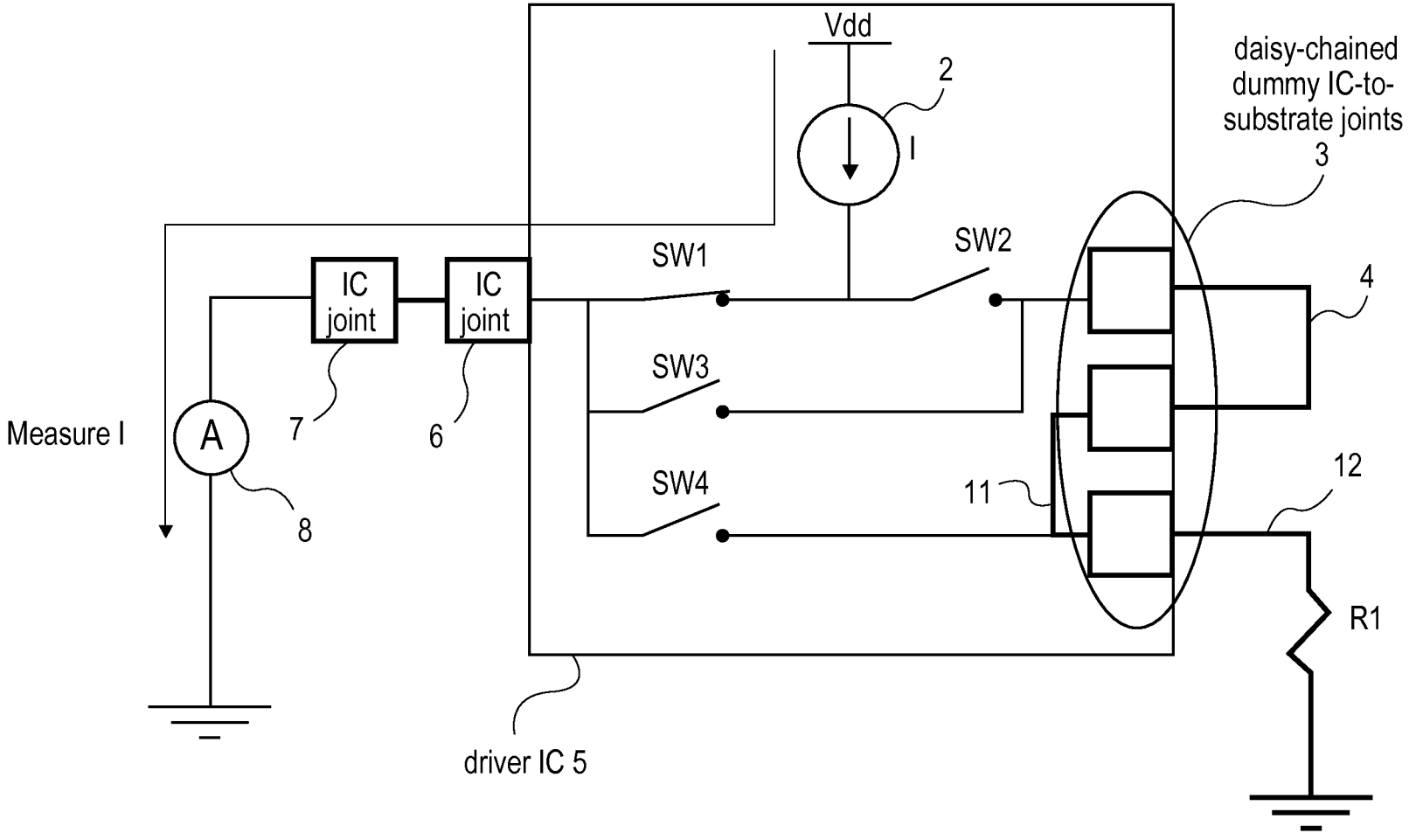
FIG. 3A depicts the testing circuitry in a first configuration, used for measuring the current provided by the current source.
Figure 3B:
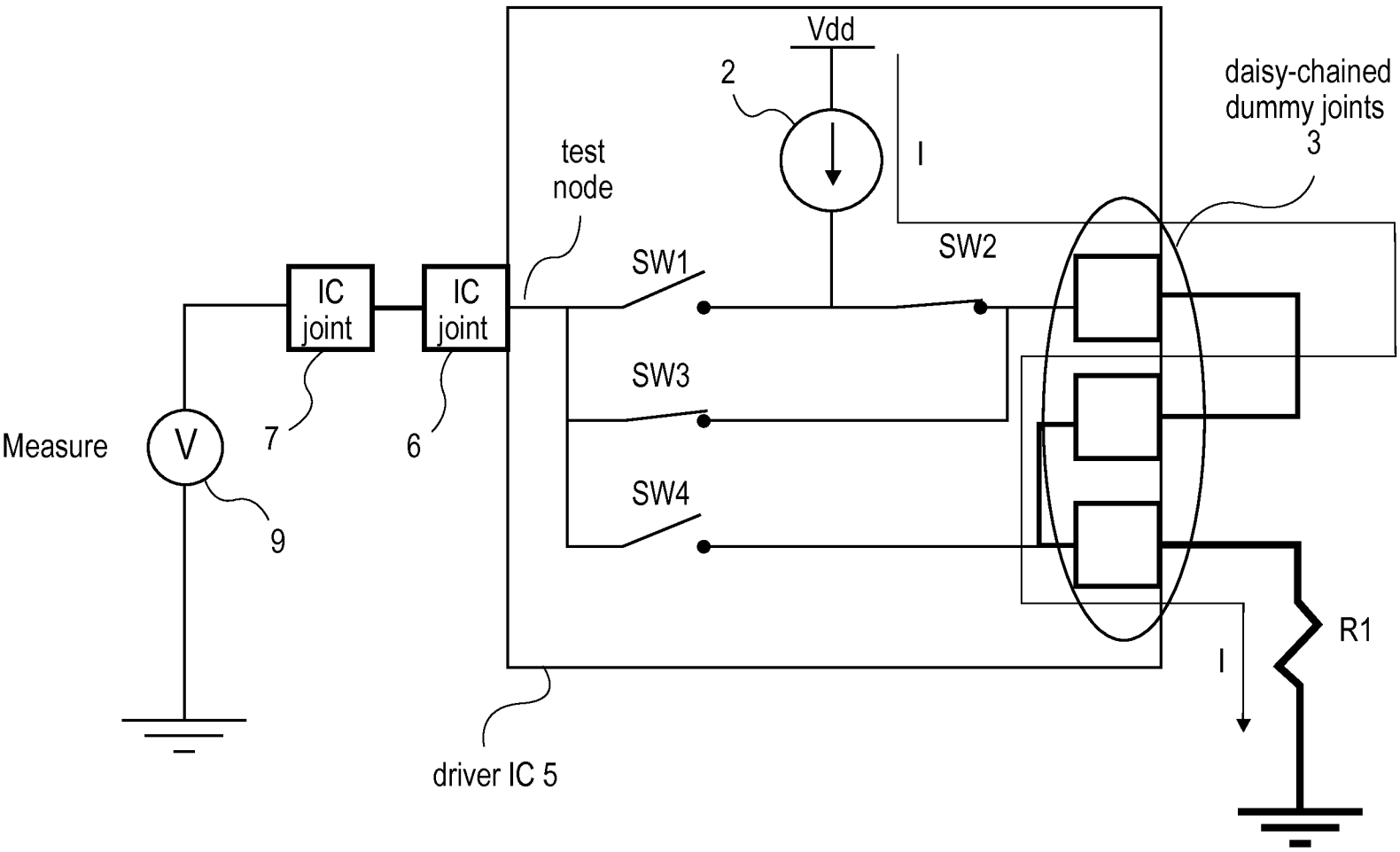
FIG. 3B depicts the testing circuitry in a second configuration, used for measuring a voltage at an end node of the daisy chained joints.
Figure 3C:
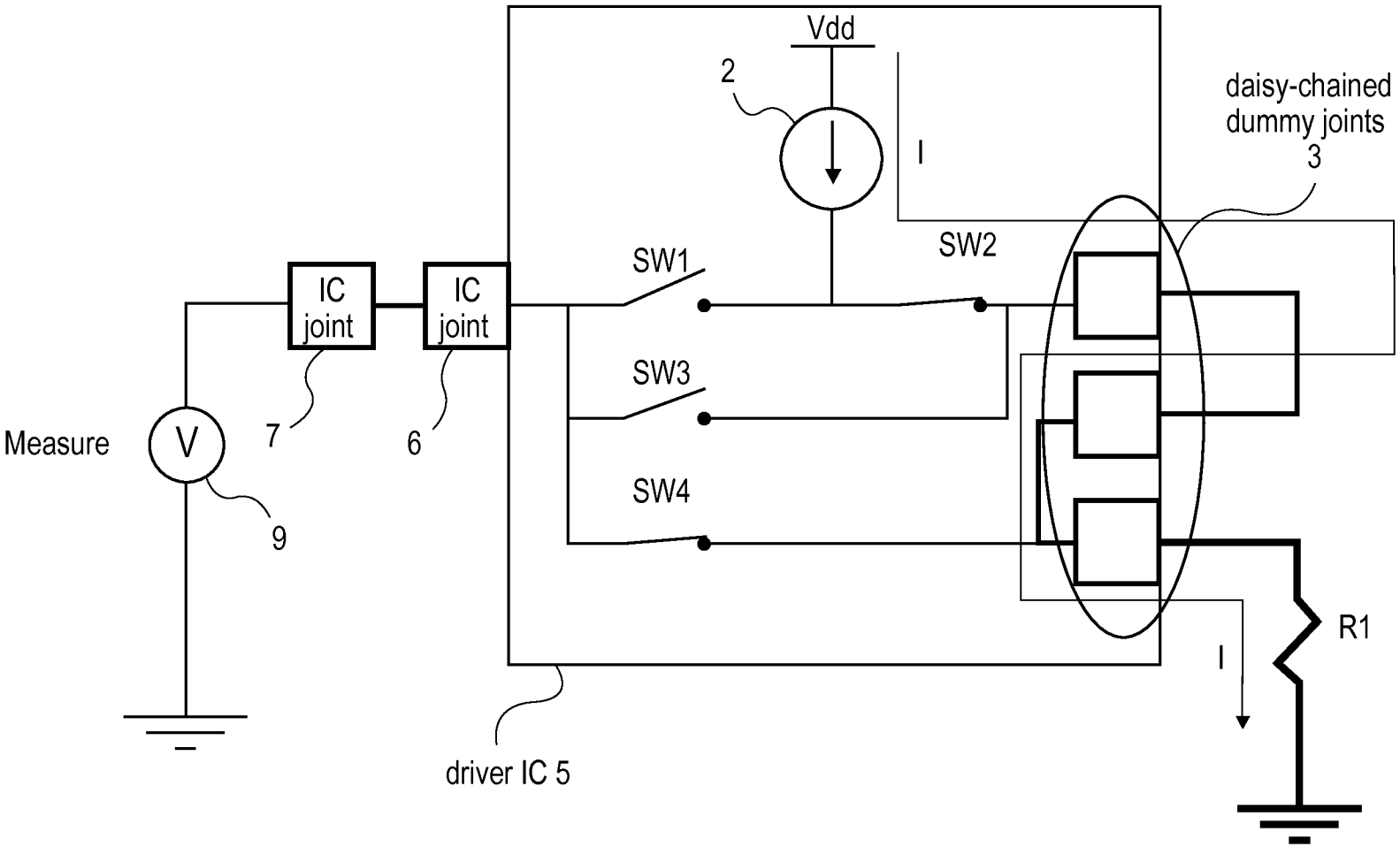
FIG. 3C depicts the testing circuitry in a third configuration, used for measuring a voltage at another end node of the daisy chained joints.

FIG. 2 also shows a signal routing means, including in this example four switches sw1-sw4 connected as shown, which serves to perform the following routing functions (used in the testing process described below):

configuration a) routes the current I through a test node of the IC, which in this case is directly connected to another IC-to-substrate joint 6 and a flex-to-substrate joint 7, by closing switch sw1 and keeping all of the others open—see FIG. 3A;

configuration b) routes the current I through the daisy chained joints 3 while connecting an end node of the daisy chained joints 3 to the test node, which in effect may route the end node voltage to the test node, by closing sw2 and sw3 and keeping sw1 and sw4 open—see FIG. 3B; and configuration c) routes the current I through the daisy chained joints 3 while connecting another end node of the joints 3 to the test node, by closing sw2 and sw4 and keeping sw1 and sw3 open—see FIG. 3C.

The switches sw1-sw4 may be controllable by a tester, which may be used to automatically conduct or manage the testing process (see FIG. 4 described below). Each switch can be described as selectively providing a path (open or closed), under control of the tester. While sw1 and sw2 provide paths that couple the test node and the first node of the joints 3, respectively, to a "near" node of the current source 2 (where a "far" node of the current source 2 is in this case directly connected to a power supply node Vdd), sw3 provides a path that couples the test node and the first end node directly, bypassing the sw1 and sw2 (and the near node of the current source 2). This presents essentially identical parasitic resistance to the voltage measurements taken at the test node (through switches sw3 and sw4 which may be replicates of each other), of the first and second end nodes of the joints 3, thereby improving the accuracy of the computed resistance estimate.

Before describing a testing process, it should be noted that to further improve accuracy of the computed resistance estimate, still referring to FIG. 2, the conductive routing that is added to form the daisy chaining of the joints 3 (namely on-display panel routing 4 and in-driver IC routing 11), as well perhaps the trace 12 that connects the third joint to the resistor R1, should have relatively negligible resistance (relative to the resistance of any of the IC-to-substrate joints). Accordingly, FIG. 2 depicts these routings and the trace 12 in thicker lines, representing heavier metallization for reduced resistance.

A method for testing IC-to-substrate joints, such as those that electrically connect a display driver IC 5 to a display panel substrate as depicted in FIG. 1 and FIG. 2, may proceed as follows. Note that although the operations below are described sequentially or with terms such as "next" or "then", this is only done to ease the understanding of the concept here as some of the operations may be performed in a different order. In a first operation, the circuitry in FIG. 2 is configured into that of FIG. 3A, in which an ammeter circuit 8 is coupled to a test node of the driver IC 5 (e.g., through one or both of the flex-to-substrate joint 6 and IC-to-substrate joint 7), while a switch network in the driver IC 5 couples the test node to the current source 2. This is achieved in this case by closing sw1 and keeping sw2-sw4 open as shown. This enables a measured current output of the ammeter circuit 8, being a measurement of the current I, to be recorded, e.g. by a tester—see FIG. 4.

In a second operation, the circuitry in FIG. 2 is configured into that of FIG. 3B where a voltmeter 9 (instead of the ammeter 8) is directly connected to the test node, while the switch network in the driver IC 5 couples the test node to an end node of the dummy IC-to-substrate joints 3 that are daisy chained. A measured voltage output of the voltmeter 9 is recorded in this configuration, while the current I is being fed through the joints 3 (by virtue of sw2 being closed). Note in this case that sw1 and sw4 remain open during the measurement.

In a third operation, the circuitry in FIG. 2 is configured into that of FIG. 3C where the voltmeter 9 is coupled to the test node while the driver IC 5 couples the test node to another end node of the daisy chained joints 3. A measured voltage output of the voltmeter 9 is recorded in this configuration while the current I is being fed through the joints 3 (by virtue of sw2 being closed). Note in this case that sw1 and sw3 remain open during the measurement.

A figure of merit is then computed for the electrical connections of the driver IC 5 to the display panel substrate, using the first and second measured voltage outputs and the measured current output. This may be based on computing a ratio of the difference between the two measured voltage outputs, and the measured current output, e.g. a resistance value or an admittance value.

Figure 4:
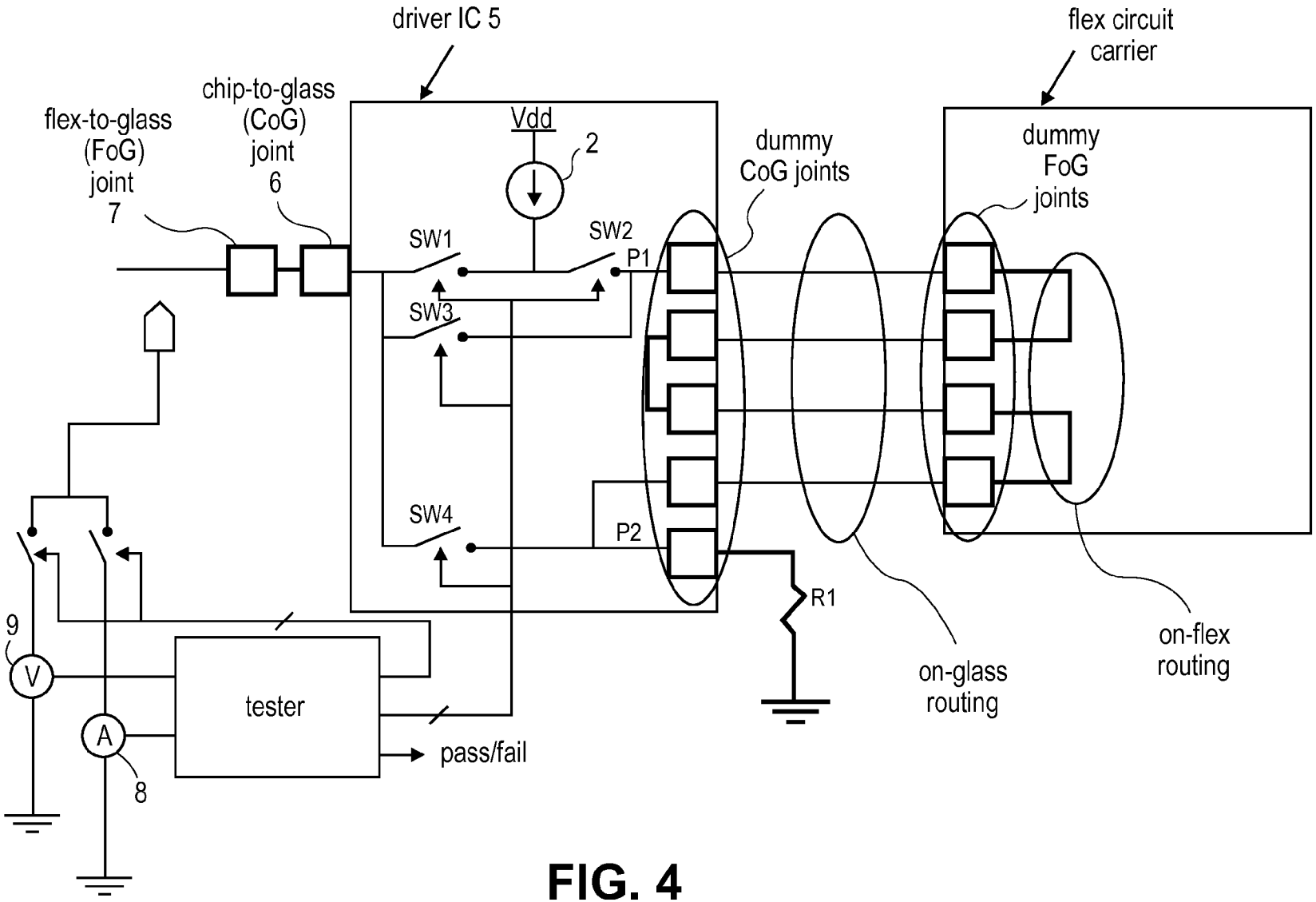
FIG. 4 shows a combined circuit schematic and block diagram of a display system undergoing a testing process conducted by a tester.

FIG. 4 shows a combined circuit schematic and block diagram of a display system undergoing a testing process conducted by a tester. The system here is similar to the one depicted in FIG. 1 in that CoG joints connect the driver IC 5, through on-glass routing, to FoG joints which connect to a flex circuit carrier. More particularly, a group of dummy CoG joints are shown that are daisy chained with a group of dummy FoG joints, still coupled in series with a resistor R1. The same approach described above in connection with FIG. 2 and FIGS. 3*a*-3*c* may be taken here to compute a resistance value for the path from P1 to P2, noting that in this case the path also includes FoG joints and on-glass routing between each CoG-FoG pair, such that the resistance estimate is that of the entire path.

FIG. 4 also shows an embodiment of the invention that was described earlier as being also applicable to the arrangement depicted in FIG. 2 and in FIGS. 3*a*-3*c*, namely automated control of the testing process by the tester. The tester (e.g., a programmed digital processor) provides control signals to control the switches sw1-sw4 and the connection of the ammeter (A) and the voltmeter (V) to the test node of the driver IC 5, has access to record the measured outputs of the voltmeter (V) and ammeter (A), computes the figure of merit (resistance or admittance), and based on that can provide a pass/fail indication for the joints being tested, based on having compared the figure of merit to a threshold. In one embodiment, although not shown, the tester may be part of external automatic test equipment (ATE) that also has control of a probe mechanism which may have multiples probes for making and breaking electrical contacts with a measurement test point (for connecting to the voltmeter or the ammeter) and with control test points (not shown) for supplying controls signal to the switches sw1-sw4. In another embodiment, the tester together with the ammeter and the voltmeter may be integrated into the driver IC 5, thereby avoiding the need for any external probes to make contact with the voltage/current measurement test point through FoG/CoG 7/6. Alternatively, they may be combined into a separate tester chip that is hardwired to the driver IC via the flex circuit carrier.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although FIG. 2 shows the current I being provided by a current source 2 in a "high side" arrangement where the current I is understood as being drawn from the power supply node at Vdd, an alternative is to use a current sink to provide the current I in a "low side" arrangement where the Vdd and ground labels in the FIG. 3A configuration may be swapped. Also, while most of the Detailed Description refers to the testing circuitry being part of a display driver IC 5, the testing circuitry which includes the current source, the switch network, the daisy chained joints, and the test node, could alternatively be distributed across two or more IC dies that have different functions. The description is thus to be regarded as illustrative instead of limiting.

What is claimed is:

1. A system comprising:

a display panel substrate in which a pixel array region is formed;

a driver circuit coupled to drive the pixel array region using signals that are to be transferred between the driver circuit and circuitry external to the driver circuit via a plurality of IC-to-substrate joints formed on the display panel substrate;

a plurality of dummy IC-to-substrate joints of the driver circuit that are daisy chained from a first end to a second end;

a current source to provide a current; and signal routing means for directly routing the current a) through a test node and not through the daisy chained dummy joints, b) through the daisy chained dummy joints while directly routing the first end of the daisy chained dummy joints to the test node, and c) through the daisy chained dummy joints while directly routing the second end of the daisy chained dummy joints to the test node.

2. The system of claim 1 wherein the driver circuit is an IC die, the display panel substrate is a glass panel, and the IC-to-substrate joints are chip-on-glass (CoG) joints.

3. The system of claim 2 further comprising a resistor coupled in series with the daisy chained dummy joints.

4. The system of claim 3 wherein the resistor is connected outside of the daisy chained dummy joints.

5. The system of claim 3 wherein the resistor is a passive resistor element that is in the IC die.

6. The system of claim 2 further comprising a plurality of flex-on-glass (FoG) joints that serve to transfer the signals between the driver circuit and external circuitry via a flexible printed circuit carrier, and a plurality of dummy FoG joints that are daisy chained with the plurality of dummy CoG joints.

7. The system of claim 1 wherein the signal routing means comprises first, second, and third switches that are controllable by a tester, the first switch to selectively provide a first path that directly couples the test node to the current source, the second switch to selectively provide a second path that directly couples the current source to the first end of the daisy chained dummy joints, and the third switch to selectively provide a third path that directly couples the test node to the second end of the daisy chained dummy joints.

8. The system of claim 7 wherein the plurality of switches further comprises a fourth switch to selectively provide a fourth path that directly couples the test node to the first end of the daisy chained dummy joints while bypassing the second path that directly couples the current source to the first end of the daisy chained dummy joints.

9. The system of claim 1 wherein the driver circuit further comprises an interface to a tester, the interface to receive control signals from the tester for controlling the signal routing means while testing IC-to-substrate joints.

10. A display system comprising:

a substrate in which a pixel array region is formed; and a display driver integrated circuit (IC) having integrated therein a plurality of pads to transfer signals between the driver IC and external circuitry, wherein the plurality of pads are to form a plurality of IC-to-substrate joints on the substrate, a further plurality of pads that are to form a plurality of dummy IC-to-substrate joints on the substrate that are to be daisy chained from a first end to a second end, a current source to provide a current, and a switch network that is to selectively route the current through i) a test node of the driver IC and not through the daisy chained dummy joints ii) the daisy chained dummy joints while connecting the first end of the daisy chained dummy joints to the test node, and iii) the daisy chained dummy joints while connecting the second end of the daisy chained dummy joints to the test node.

11. The display system of claim 10 wherein the substrate is a glass panel.

12. The display system of claim 10 wherein the driver IC further comprises an interface to a tester, the interface to receive control signals from the tester for controlling the selective routing by the switch network.

13. The display system of claim 10 further comprising a resistor coupled in series with the daisy chained dummy IC-to-substrate joints.

14. The display system of claim 13 wherein the resistor has a terminal that is directly connected to the second end.

15. The switch network of claim 10 wherein the switch network comprises first, second, and third switches that are controllable by a tester, the first switch to selectively provide a first path that couples the test node to the current source, the second switch to selectively provide a second path that couples the current source to the first end of the daisy chained dummy joints, and the third switch to selectively provide a third path that couples the test node to the second end of the daisy chained dummy joints.

16. The display system of claim 15 wherein the switch network further comprises a fourth switch to selectively provide a fourth path that couples the test node to the first end of the daisy chained dummy joints while bypassing the second path that couples the current source to the first end of the daisy chained dummy joints.

* * * * *